United States Patent [19]

Futamura et al.

[11] 3,950,945

[45] Apr. 20, 1976

[54] ADJUSTABLE MOUNTING FOR THE CORE OF A MANIFOLD REACTOR

[75] Inventors: Kazumasa Futamura, Toyota; Masami Yamazaki, Toyokawa, both of Japan

[73] Assignee: Toyota Jidosha Kogyo Kabushiki Kaisha, Toyoto, Japan

[22] Filed: May 6, 1975

[21] Appl. No.: 574,869

[30] Foreign Application Priority Data

Nov. 6, 1974 Japan ..... 49-133728[U]

[52] U.S. Cl. ..... 60/322; 60/323

[51] Int. Cl.[2] ..... F01N 7/00; F01N 7/10

[58] Field of Search ..... 60/282, 322, 323, 302

[56] References Cited

UNITED STATES PATENTS

| | | | |
|---|---|---|---|
| 2,678,529 | 5/1954 | Buchi | 60/322 X |
| 3,756,027 | 9/1973 | Gotoh et al. | 60/323 |
| 3,799,196 | 3/1974 | Scheitlin et al. | 60/322 X |

*Primary Examiner*—Carlton R. Croyle
*Assistant Examiner*—Thomas I. Ross
*Attorney, Agent, or Firm*—Stevens, Davis, Miller & Mosher

[57] ABSTRACT

A manifold exhaust gas reactor for purifying exhaust gas produced in an internal combustion engine comprising an outer core and an inner core both usually made of metal plate and defining therebetween a recombustion chamber for exhaust. A plurality of screws pierce through the wall of said reactor casing in order to fit the outer core and each screw-head adjustably urged on the outer surface of said outer core in slidingly contacting relation thereto so that the outer core can be protected from stress either in the longitudinal direction or in the radial direction by adjusting said outer core fixing screws.

4 Claims, 7 Drawing Figures

ADJUSTABLE MOUNTING FOR THE CORE OF A MANIFOLD REACTOR

BACKGROUND OF THE INVENTION

This invention relates to a manifold reactor for use in purifying exhaust gas from an internal combustion engine.

A manifold reactor, in general, is provided in an exhaust gas discharging system, for removing by the oxidation reaction unburnt detrimental matters, such as HC and CO, contained in exhaust gas from an internal combustion engine.

A manifold reactor of the prior art is so designed that a recombustion chamber is provided in the core portion and the recombustion chamber is maintained in a temperature as high as possible, so that the oxidation reaction of detrimental gas may be facilitated. To this end, the outer peripheral portion of the recombustion chamber is covered with a heat insulating material such as ceramic fibers, to the effect that escape of heat is minimized.

However, shortcomings are encountered with the reactor of the prior art that, due to heat of high temperature of exhaust gases as well as due to engine vibrations, the components of the reactor are subjected to thermal stress and vibration stress, resulting in displacement of the heat insulating material or the scattering thereof, with resultant lowered heat insulating effect.

For comparison purposes, a reactor of the prior art is shown in a fragmentary horizontal cross-sectional view in FIG. 1 and in a cross-sectional view in FIG. 2 which is taken along the line II—II of FIG. 1. Referring to FIGS. 1 and 2, a manifold reactor casing 1, which is composed of two separable casings 1*a* and 1*b*, is rigidly secured by means of a bolt 2 to an engine E. The reactor casing 1 houses therein an outer core 4 made of a sheet metal and an inner core 5 made of a sheet metal, between which is defined a recombustion chamber. The inner core 5 is supported in the outer core 4 by suitable means. Exhaust gas discharged from an exhaust port of an engine is introduced via an inlet port liner 8 of the reactor into the combustion chamber in the inner core 5. The opposite ends of the inner core 5 are opened, so that the exhaust gas may be discharged, via the recombustion chamber defined between the inner core and the outer core, and then via an outlet port 9 welded to the outer core 4, to an exhaust pipe 10. A heat insulating material 3 such as ceramic fiber is sealingly filled in a space defined between the outer casing 1 and the outer core 4. One casing 1*a* has on its inner wall an inwardly raised portion 1*c* whose flat free end abuts with the outer wall of the outer core 4. The raised portion 1*c* of the casing 1*a* serves as an outer casing fixing support, so that the casing 1*a* and the outer core 4 may be rigidly fastened by a bolt 7 threaded in the raised portion. The outer core fixing support is usually provided substantially in the mid portion of the overall length of the reactor casing 1 in view of thermal expansion. Due to vibration of the outer core 4 which results from vibration of the engine, the heat insulating material filled between the reactor casing 1 and the outer core 4 is squeezed and displaced to one side. For this reason, vibration to the outer core must be absolutely controlled. In the reactor shown in FIGS. 1 and 2, plural raised portions 1*c* are provided in several portions on the inner wall of the reactor casings 1*a* and 1*b*, in a manner to abut their flat free ends with the outer wall of the outer core 4 which constitutes the outer wall of the recombustion chamber, so that the outer core 4 may be rigidly supported thereon, so as to be independent of vibration of the engine. In a reactor of this type, however, because of the reactor casing being composed of two separate casings and the outer core being made of a sheet metal, it is difficult to accurately abut the reactor casing with the outer core in the assembly, with unsatisfactory results in protecting the outer core from vibration and hence preventing the squeezing and displacement of the heat insulating material.

SUMMARY OF THE INVENTION

It is accordingly an object of the present invention to provide a manifold reactor, which is improved in construction and free from the drawbacks described.

The gist of the present invention consists in that; in a manifold reactor for use in an internal combustion engine which includes; a reactor casing; an inner core and an outer core, which are both disposed in the reactor casing and define a recombustion chamber for exhaust gas therebetween; an inlet port for introducing exhaust gas from the engine into the inner core; and an outlet port connected to the outer core and discharging the exhaust gas to an exhaust pipe; the manifold reactor comprises; a heat insulating material filled between the reactor casing and the outer core; a plurality of outer core fixing screws piercing the reactor casing, the head portion of respective outer core fixing screw being adjustably urged on the outer core in slidingly contacting relation thereto, whereby stress which may arise in the longitudinal axial direction and radial direction of the outer core is avoided by adjusting the outer core fixing screws.

BRIEF DESCRIPTION OF THE DRAWINGS

The above and other objects, features and advantages of the invention will become clear from the following description and the appended claims, when taken in conjunction with the accompanying drawings which show by way of prior art example and preferred embodiments according to the present invention wherein:

DESCRIPTION OF PREFERRED EMBODIMENTS

Figure 1:
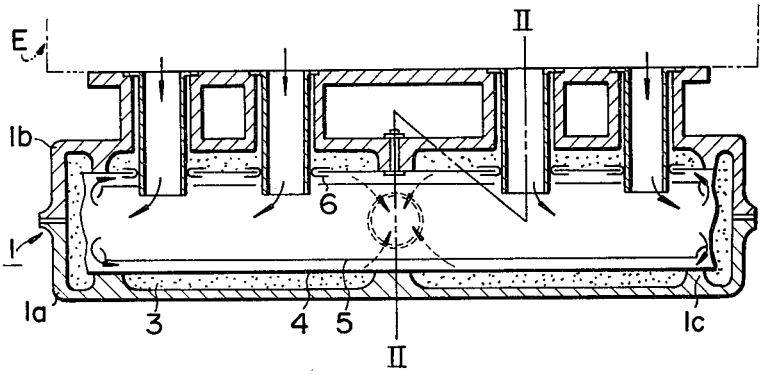
FIG. 1 PRIOR ART
FIG. 1 is a horizontal cross-sectional view of a reactor of the prior art.
Figure 2:
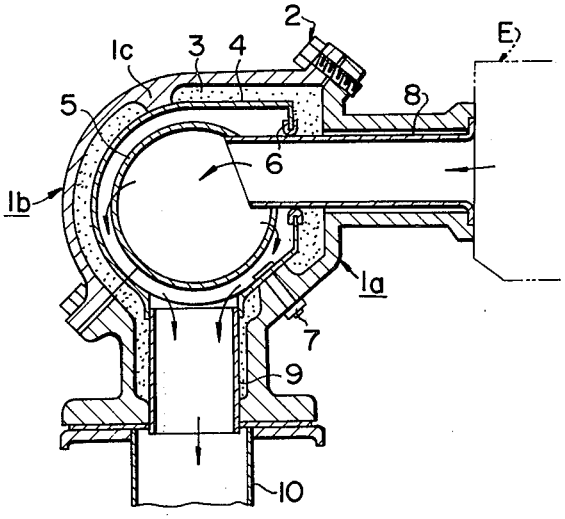
FIG. 2 is a cross-sectional view taken along the line II—II of FIG. 1.
Figure 3:
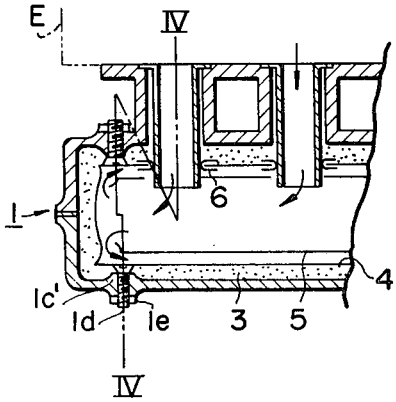
FIG. 3 is a fragmentary horizontal cross-sectional view of a reactor of one embodiment of the present invention.
Figure 4:
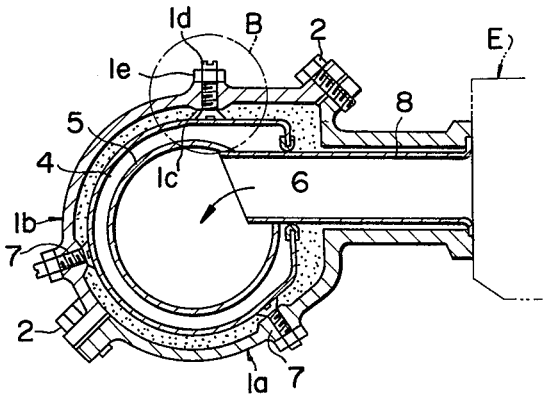
FIG. 4 is a cross-sectional view taken along the line IV—IV of FIG. 3.
Figure 5:
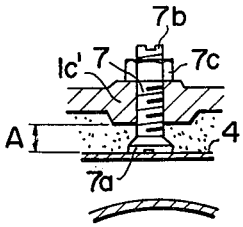
FIG. 5 is an enlarged view of a portion B encircled in FIG. 4.

Description will hereunder be given to embodiments of the present invention in conjunction with FIGS. 3 through 7. FIG. 3 shows a fragmentary horizontal cross-sectional view of a manifold reactor of an embodiment of the present invention; FIG. 4 is a cross-sectional view taken along the line IV—IV of FIG. 3, and FIG. 5 is an enlarged view of portion B of FIG. 4. In these drawings, components common to those of the prior art shown in FIGS. 1 and 2 are shown by the same reference numerals. A manifold reactor casing 1 is composed of two separate casings 1*a* and 1*b*, which are rigidly fastened by bolts 2 to each other. The casing 1 is rigidly attached to an engine E. An outer core 4 made of a sheet metal is disposed in the reactor casing 1, and houses therein an inner core 5 supported thereon by any suitable means. Exhaust gas from an exhaust port of the engine is introduced via an inlet port liner 8 of the reactor into a combustion chamber in the inner core 5, and then discharged from the opposite open ends of the inner core 5, via the recombustion chamber defined between the inner core and the outer core 4 and then via an outlet port 9 welded to the outer core 4, into an exhaust pipe 10. A space defined between the reactor casing 1 and the outer core 4 is sealingly filled with a heat insulating material such as ceramic fibers. Between respective raised portions 1*c*′ formed on the inner wall of the reactor casing and the outer periphery of the outer core 4, there is left a gap, which is shown by the reference A in FIG. 5. The gap A is not provided in the prior art shown in FIGS. 1 and 2. A fixing screw 7, which is to be screw-threaded in a respective raised portion of the casing, has a flush head 7*a* for ready close abutment with the outer periphery of the outer core, and a grooved end 7*b*, for screw driver engagement. Plural raised portions 1*c*′ provided in proper portions on the inner wall of the reactor casing 1 are each provided with a threaded hole. When respective outer core fixing screw 7 is screw-threaded in the threaded hole, it is turned by engaging a screw driver with the grooved end 7*b* of respective screw, until the flush head 7*a* of the screw abuts the outer core 4. In this case, the fixing screws 7 must be screw-threaded in the raised portions in a manner so that their flush head 7*b* all bear on the outer core 4 with uniform force. It should be noted that the outer core is slidable relative to the flush heads 7*a* of respective screws 7, for protecting the outer core against elongation in the longitudinal direction due to thermal expansion, while for protecting the outer core against the elongation in the radial direction, the fixing screws are strongly fastened or loosened for adjusting the extent of being screw-threaded in the threaded holes, whereby the outer core 4 is maintained free from thermal stress. Thus, the outer core 4 is rigidly secured to the reactor casing 1 substantially integrally therewith, and maintained free from thermal stress, such that the heat insulating material 3 filled between the reactor casing 1 and the outer core 4 is prevented from being squeezed by the outer core or being displaced to one portion.

Figure 6:
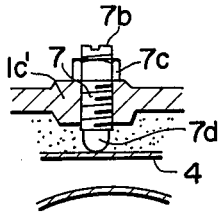
FIG. 6 is a fragmentary cross-sectional view showing another embodiment of the present invention; and, FIG. 7 is a cross-sectional view of an essential part of a further embodiment.
Figure 7:
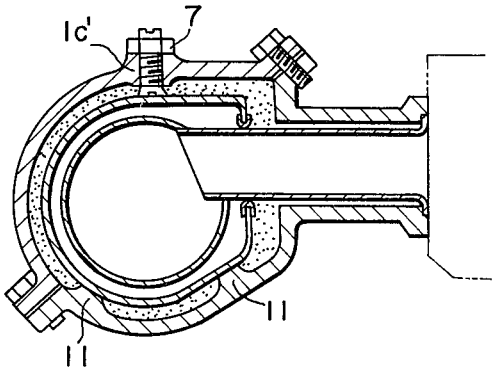

FIG. 6 shows another embodiment of the present invention, wherein fixing screw 7 has a round head, rather than the flush head shown in FIG. 5. The fixing screws 7 with a round head bring about substantially the same result as those of the first embodiment. FIG. 7 shows a further embodiment of the present invention, wherein the outer core fixing screw 7 is screw-threaded in only one of the raised portions, with the other raised portions having a flat face for abutment with the outer core. This contrasts with the preceding embodiment shown in FIG. 4, in which the outer core fixing screws are screw-threaded in all of the raised portions 1*c*′.

According to the present invention, the reactor casing and the outer core are so constructed that the component of the manifold reactor is subjected to neither vibration stress accruing from vibration of the engine nor thermal stress resulting from heat expansion, and hence avoids the displacement of the heat insulating material to one side as well as the scattering thereof, resulting in the satisfactory heat insulating effects, with the assurance of usually maintaining the recombustion chamber in an elevated temperature.

What is claimed is:

1. A manifold reactor for use in an internal combustion engine, which includes; a reactor casing; an outer core and inner core disposed in said reactor casing, said outer core and inner core defining therebetween a recombustion chamber for exhaust gas; an inlet port for introducing exhaust gas from an engine into said inner core; and outlet port connected to said outer core and discharging exhaust gas to an exhaust pipe; the improvements comprising;

a heat insulating material filled between said reactor casing and said outer core; and, a plurality of outer core fixing screws piercing the wall of said reactor casing, said outer core fixing screws each having a screw-head adjustably urged on the outer surface wall of said outer core in slidingly contacting relation thereto, whereby the outer core is protected from stress either in the longitudinal direction or in the radial direction by adjusting said outer core fixing screws.

2. A manifold reactor according to claim 1, wherein said outer core fixing screws respectively have screw-heads of round shape.

3. A manifold reactor according to claim 1, wherein said outer core fixing screws respectively have screw-heads of flush head shape.

4. A manifold reactor for use in an internal combustion engine, which includes; a reactor casing; an outer core and inner core disposed in said reactor casing, said outer core and inner core defining therebetween a recombustion chamber for exhaust gas; an inlet port for introducing exhaust gas from an engine into said inner core; and outlet port connected to said outer core and discharging exhaust gas to an exhaust pipe; the improvements comprising;

a heat insulating material filled between said reactor casing and said outer core; and, a plurality of raised portions on the reactor case, an outer core fixing screw threaded through only one of the raised portions and adjustably pressing the outer surface of said outer core for abutment with flat surfaces of the other raised portions inside said reactor casing.

* * * * *